US005725691A

United States Patent [19]

Liu

[11] Patent Number: 5,725,691

[45] Date of Patent: Mar. 10, 1998

[54] NICKEL ALUMINIDE ALLOY SUITABLE FOR STRUCTURAL APPLICATIONS

[75] Inventor: Chain T. Liu, Oak Ridge, Tenn.

[73] Assignee: Lockheed Martin Energy Systems, Inc., Oak Ridge, Tenn.

[21] Appl. No.: 609,010

[22] Filed: Feb. 29, 1996

Related U.S. Application Data

[63] Continuation of Ser. No. 200,915, Feb. 22, 1994, abandoned, which is a continuation of Ser. No. 913,858, Jul. 15, 1992, abandoned.

[51] Int. Cl.[6] ..... C22C 19/03

[52] U.S. Cl. ..... 148/409; 148/429; 420/460

[58] Field of Search ..... 420/550, 551, 420/580, 460, 445; 148/409, 419, 429, 437, 442, 410, 428

[56] References Cited

U.S. PATENT DOCUMENTS

| | | | |
|---|---|---|---|
| 2,910,356 | 10/1959 | Grala et al. | 420/460 |
| 4,612,165 | 9/1986 | Liu et al. | 420/459 |
| 4,711,761 | 12/1987 | Liu et al. | 420/459 |
| 4,731,221 | 3/1988 | Liu | 420/445 |
| 4,839,140 | 6/1989 | Cathcart et al. | 420/445 |
| 5,116,691 | 5/1992 | Darolia et al. | 420/460 |

OTHER PUBLICATIONS

"Alloys Based on NiAl for High Temperature Applications", Vedula, et al., *Met.Res.Soc.Proc.*, 39 (1985), p. 413.

"Tensile Properties of NiAl and Niti"; A. G. Rozner and R. J. Wasilewski; *J. Inst Met. 94, 169 (1966).*

"Room Temperature Tensile Ductility in Polycrystalline B2 NiAl"; K.H. Hahn and K. Vedula; *Scr. Mettal.;* vol. 23, pp. 7–12.

"NiAl Alloys for High–Temperature Structural Applications"; Ram Darolia; *Journal of the Institue of Metals;* Mar. 1991; p. 44–49.

"Brittle Fracture and Grain Boundary Chemistry of Microalloyed NiAl"; *J. Mater. Res.*, 5, No. 4., 754 (Apr. 1990).

"Alloys Based On NiAl for High Temperature Appications" K. Vedula, et al, in *Met. Res. Soc. Proc.*, 39, 412 (1985).

Brittle Fracture And Grain Boundary Chemistry Of Microalloyed NiAl, George and Chain, J. Mater. Res., vol. 5, vo. 4, Apr. 1990, pp. 754–762.

Room Temperature Tensile Ductility In Polycrystalline B2 NiAl, Hahn, et al., Pergamon Press, Scripta Metallurgica, vol. 23, pp. 7–12, 1989.

Tensile Properties Of NiAl and Niti, Rozner, et al., Journal of the Institute of Metals, vol. 94, 1966, pp. 169–175.

NiAl Alloys For High–Temperature Structural Applications, Darolia, JOM, Mar. 1991, pp. 44–49.

Alloy Based On NiAl For High Temperature Applications, Vedula, et al. Mat. Res. Soc. Symp. Proc. vol. 39, 1985 Mat. Res. Soc. pp. 411–421.

*Primary Examiner*—George Wyszomierski

*Attorney, Agent, or Firm*—Jeffrey N. Cutler

[57] ABSTRACT

Alloys for use in structural applications based upon NiAl to which are added selected elements to enhance room temperature ductility and high temperature strength. Specifically, small additions of molybdenum produce a beneficial alloy, while further additions of boron, carbon, iron, niobium, tantalum, zirconium and hafnium further improve performance of alloys at both room temperature and high temperatures. A preferred alloy system composition is Ni—(49.1±0.8%)Al—(1.0±0.8%)Mo—(0.7±0.5%) Nb/Ta/Zr/Hf—(nearly zero to 0.03%)B/C, where the % is at. % in each of the concentrations. All alloys demonstrated good oxidation resistance at the elevated temperatures. The alloys can be fabricated into components using conventional techniques.

5 Claims, 4 Drawing Sheets

NICKEL ALUMINIDE ALLOY SUITABLE FOR STRUCTURAL APPLICATIONS

This is a continuation of application Ser. No. 08/200,915 filed on Feb. 22, 1994, now abandoned, which is a file wrapper continuation application based upon patent application Ser. No. 07/913,858 filed Jul. 15, 1992, now abandoned.

DESCRIPTION

This invention was made with Government support under contract DE-AC05-840R21400 awarded by the U.S. Department of Energy, Advanced Industrial Concepts Materials Program, to Martin Marietta Energy Systems, Inc., and the Government has certain rights in this invention.

TECHNICAL FIELD

The present invention relates generally to compositions for fabricating structural components, and more particularly to compositions having substantially equal proportions of nickel and aluminum to which are added small quantities of other constituents to improve room temperature ductility and elevated temperature strength.

BACKGROUND ART

In recent years significant improvements have been made in compositions for structural components useful in advanced technology processes and equipment. Typical of the areas where such structural components are utilized are in turbines and jet engines, advanced heat engines, energy conversion systems, thermal industrial systems, high-temperature tool materials, high temperature dies for metal fabrication and in the glass industry.

One group of the "super alloys" developed for use in these technical fields is based upon the use of tri-nickel aluminide ($Ni_3Al$). Through the addition of various components to the tri-nickel aluminide, improved ductility and strength have been achieved. Typical of the work in this field are U.S. Pat. Nos. 4,612,165 issued to C. T. Liu, et al on Sep. 16, 1986; 4,711,761 issued to C. T. Liu, et al on Dec. 8, 1987; 4,731,221 issued to C. T. Liu on Mar. 15, 1988; and 4,839,140 issued to J. V. Cathcart, et al on Jun. 13, 1989. In addition, there has been considerable technical literature that discusses these systems.

Although the tri-nickel aluminide based alloys provide an advance over their predecessors of the nickel-chromium alloys, their physical properties still prevent their use in some applications. For example, their melting point (typically 1395° C.) is often a limitation. Similarly, a lower density, a higher Young's modulus and thermal conductivity, and an increased resistance to oxidation is needed for some applications.

Limited studies have been made of alloys containing substantially equal proportions of nickel and aluminum forming NiAl alloys. Typical of these studies are those reported by K. H. Hahn and K. Vedula in *Scr. Metall.* 23, 7 (1989), A. G. Rozner and R. J. Wasilewski, *J. Inst Met.* 94, 169 (1966), K. Vedula, et al, in *Met. Res. Soc. Proc.*, 39, 412 (1985), R. Darolia in *JOM*, 44 (March 1991, and E. P. George and C. T. Liu in *J. Mater. Res.*, 5, No. 4., 754 (April 1990). Although NiAl alloys have some physical properties that are more favorable than the tri-nickel aluminide alloys, they exhibit two major drawbacks: poor ductility at ambient temperatures; and low strength and creep resistance at elevated temperatures.

Accordingly, it is an object of the present invention to provide an alloy system for use in structural components that has a higher melting point than the compositions using tri-nickel aluminides.

A further object of the present invention is to provide an alloy system that has high resistance to oxidation at high temperatures, has substantially lower density and a higher Young's modulus than tri-nickel aluminide alloy systems.

It is another object of the present invention to provide alloy compositions based upon substantially equal proportions of nickel and aluminum, with sufficient additives to enhance room temperature ductility and high temperature strength.

Still another object of the present invention is to provide an alloy system having substantially equal proportions of nickel and aluminum, together with small additions of molybdinum and boron or carbon, as well as small additions of Nb, Ta, Zr and/or Hf to enhance mechanical properties needed for advanced technical applications.

These and other objects and advantages of the present invention will become apparent upon a consideration of the detailed description that follows, together with the presentation of comparative data.

DISCLOSURE OF THE INVENTION

In accordance with the present invention, there is provided an alloy system based upon substantially equal proportions (by atomic percent) of nickel and aluminum together with, in the preferred composition, 1±0.6 at. % molybdinum. To this can be added a small amount of boron or carbon as, for example, up to about 0.02 at. % to further enhance ambient temperature ductility. Further enhancement of high temperature strength is achieved through the addition of small amounts (0.6±0.4 at. %) of niobium or tantalum, and/or up to about 1 at. % of zirconium/hafnium, and/or up to about 0.6 at. % of Fe. Alloys of these compositions have greater ambient temperature ductility, increased melting point, higher Young's modulus and improved oxidation resistance relative to the tri-nickel aluminide alloys and/or NiAl alone.

BEST MODE FOR CARRYING OUT THE INVENTION

Figure 1:
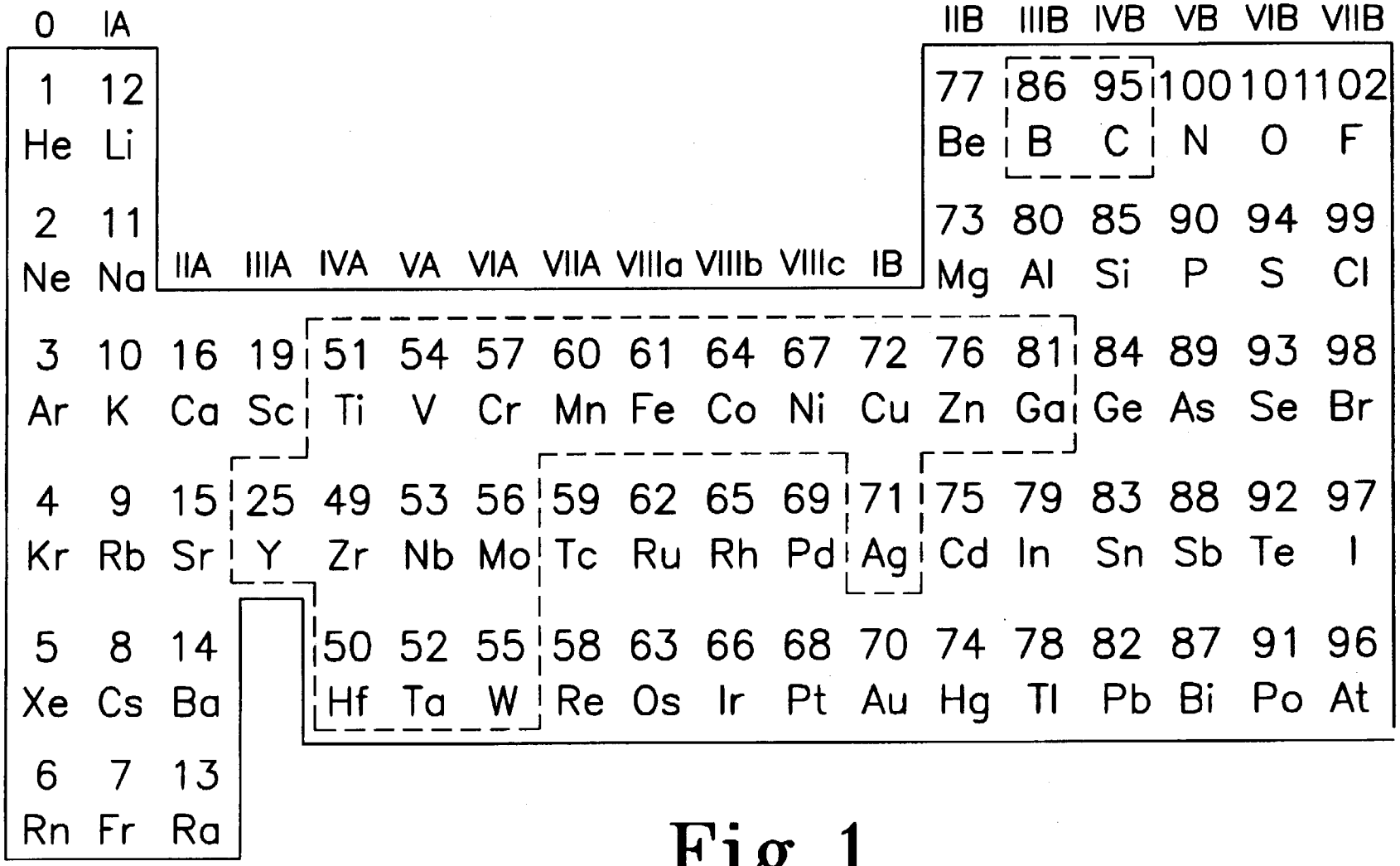
FIG. 1 is a modified periodic chart of the elements wherein is shown the location of elements that were added to NiAl in an effort to produce an alloy having improved physical properties.

A group of elements were selected for alloying with NiAl in an effort to produce an alloy of superior physical properties. These elements, which range from groups IIIA to IVB, are enclosed with a dashed line in a modified periodic chart of the elements in FIG. 1. These elements, which are listed in Table I, were chosen to replace nickel, aluminum, or both based on their chemical behavior. NiAl alloys containing up to 10 at. % of the alloying elements (except for silver which gave high evaporation loss) were prepared by arc melting using commercial-purity nickel, aluminum and alloying metals. (As used throughout, all % symbols associated with composition hereinafter refer to atomic %.) The ingots were arc melted and drop cast into cylindrical copper chill molds 25.4 mm in diameter and 102 mm in length, or into rectangular copper chill molds 25.4×1.25×114 mm. After sectioning the head, the cast ingots were canned in mild steel and extruded at 900°–1050° C. at an extrusion ratio of 6:1 to 9:1. Most of the alloys were successfully extruded to 8 mm diameter rod stock without difficulty. Rectangular ingots were fabricated into alloy plates by hot forging or hot rolling at 900°–1100° C. Because of good hot ductility of NiAl-base alloys, there are no major difficulties in fabricating these alloys into bar or plate shapes by conventional techniques such as extrusion, forging and rolling.

Buttonhead tensile specimens with a diameter of 3.2 mm in the 17.8 mm long gage section were ground from the extruded rods, electropolished and annealed in vacuum for one hour at various temperatures to produce stress-relieved, partially recrystallized or fully recrystallized grain structures for mechanical property evaluation. Most specimens were given a final anneal of one hour at 800° C. to reduce point defects. No tensile specimens could be prepared from the hot extruded rods of alloys containing 1% Cr, 1% Mn, 2% Cu or 10% Fe because they cracked during grinding. Consequently, there are no property data available from these alloys. Tensile tests of the remaining alloys were performed in air at temperatures to 1000° C. using a screw-driven Instron machine operated at an engineering strain rate of $2.4\times10^{-3}$/s. Creep tests were performed on the same type of specimens, and creep stress was calculated based on a dead-load arrangement.

Several of the alloying elements were found to have very little effect upon physical properties. These include Fe (>1 at. %), Ga and Ti, although Ti showed some improvement in strengthening at elevated temperatures.

The additions of molybdinum (Mo), tungsten (W) and vanadium (V) were studied as they affect the ambient temperature ductility and high temperature strength. Of these, W was most effective in strengthening NiAl but appeared to not affect the ductility at room temperature. Vanadium was less effective in strengthening the base alloy and significantly lowered the room temperature ductility. Alloying with V, however, improved creep properties of NiAl. Unlike the Mo- and W-containing alloys, the V-containing alloy is essentially single phase in structure.

A major improvement in ductility at ambient temperature was achieved by the addition of molybdenum to the NiAl. In the study of the effect of Mo, levels up to 3% were added to NiAl. Unalloyed NiAl recrystallizes at 800° C. after one hour, while molybdenum additions increase the recrystallization temperature to as high as 1200° C. Second-phase particles are observed in Mo-containing alloys, indicating a low solubility of molybdenum in NiAl. Mo-rich particles were found to contain as high as 45% Mo. On the basis of all tests, a Mo concentration of about 1±0.6 at. % was determined to be preferred with the Mo being substituted for both the nickel and aluminum atoms.

The tensile properties of the alloy as a function of molybdenum concentration are tabulated in Table II. All of the specimens, except for the binary NiAl alloy (NAL-31) were annealed for one hour at 1000°–1100° C. to produce a partially recrystallized microstructure which gave the best tensile properties. The alloys containing 0.2 to 2.0% Mo showed a room temperature tensile ductility of 3.3 to 4.4%, which is substantially higher than that of the unalloyed NiAl (2.2%). All of the Mo-containing alloys were ductile at 600° and 1000° C. Alloying with 0.2% Mo substantially increased the strength of the NiAl at all the test temperatures. Further increase in Mo to 3 at. % gave only a moderate increase in strength at elevated temperatures. Since the solubility of Mo is quite low (<0.1 at. %), the beneficial effect is believed to come from second-phase particles which slow down the recrystallization process and stabilize a wrought structure. The 0.7% Mo alloy (NAL-55) had a yield strength of 121 MPa at 1000° C. which is higher than that of the unalloyed NiAl by a factor of three.

Small quantities of boron are known to suppress intergranular fracture. Accordingly, boron at a level of 30 wppm (weight parts per million) was added to the 0.4% Mo alloy. Results for tensile tests are shown in Table III. The addition of boron appeared to slightly increase the ductility and strength at room temperature and at 200° C. but it does not affect the tensile properties at higher temperatures. Expressed as atomic percent, a range for boron addition is from near zero to about 0.03%. Carbon in the same concentration range can be substituted for a portion (or all) of the boron.

The effective improvement of both the room temperature ductility and high temperature strength through the addition of molybdenum was the basis for further alloying. This additional alloying utilized an alloy of 1.5% Mo (NAL-58). To this were added alloying elements niobium (Nb), tantalum (Ta) and vanadium (V). These alloys are listed in Table IV. The alloys were prepared and fabricated in the same way as indicated above, except that an extrusion temperature of 1050° C. (rather than 900°) was necessary to fabricate some of the stronger alloys, such as NAL-60. All of the additions increased the yield strength; however, this resulted in a decrease in the tensile ductility at room temperature. The alloys essentially showed a mixed fracture mode, with transgranular cleavage as the major fracture mode at room temperature. At 1000° C., Nb was most effective in strengthening without reduction in ductility. The alloy NAL-60, with 1% Nb, had a yield strength five times higher than that of the unalloyed NiAl at a corresponding temperature. All the alloys are ductile at 1000° C., with tensile ductility above 27%.

Table V lists the effect of a combination of Nb, V and Ta on the tensile properties of NiAl. In this study, the NiAl alloy containing 0.7% Mo was used as a base composition (NAL-55) for alloying additions. The results indicate that the tensile strength of this base alloy can be substantially improved by alloying with a combination of 0.4% Nb, 0.4–1.0% V and 0.24% Ta. Alloying with these elements lowers the tensile elongation at room temperature but not at 1000° C.

Figure 2:
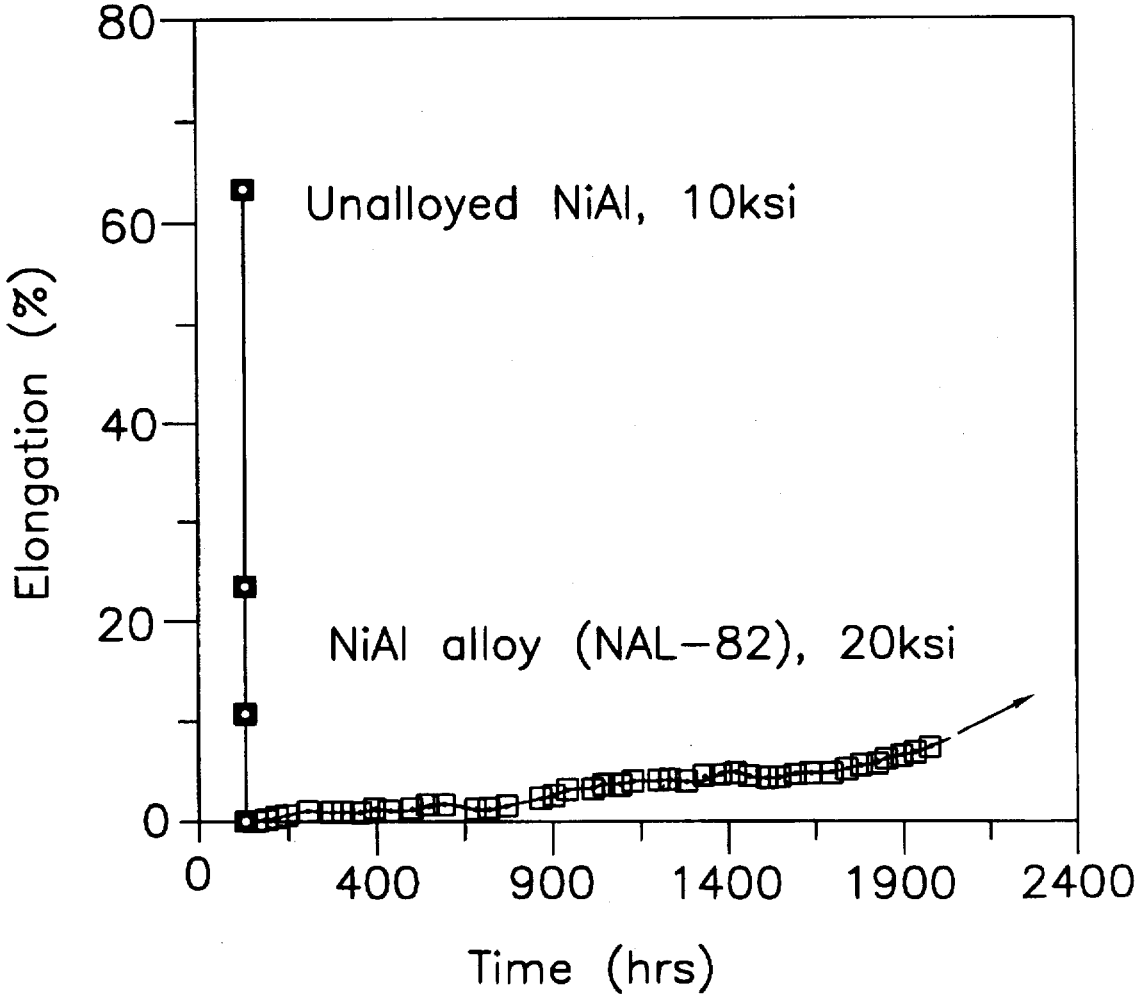
FIG. 2 is a plot of creep elongation as a function of test time for NiAl-base alloys tested at 816° C. and 68.9 and 138 MPa in air.

The effect of zirconium and other alloying additions on the tensile properties of the base alloy (NAL-55) containing 0.7% Mo is shown in Table VI. Zirconium appears to be the most effective strengthener in NiAl at both room temperature and at 1000° C. Alloying with 0.2% Zr results in more than double the yield strength of the base alloy. An increase above 0.2% Zr gives no further increase in strength. The Zr additions lower the tensile ductility at room temperature but have no adverse affect on the ductility at 1000° C. Iron (Fe) additions at a level of 0.2% appear to improve the room temperature tensile ductility of the NiAl alloy containing zirconium. Other elements, such as B, C, Nb, V and Ta slightly increase the yield strength but do not affect the tensile ductility of the Zr-containing alloys. Creep properties obtained at 138 MPa and 816° C. in air are summarized in Table VII for Mo-modified NiAl alloys with and without additions of Nb, Ta, V and Zr. Additions of Mo gave a moderate increase in the rupture life of NiAl. Addition of Nb and Ta to 1.5% Mo alloys was very effective in improving the creep properties. For example, alloying with 1% Ta extended the rupture life (of the Mo-containing alloy NAL-58) by two orders of magnitude. Among all alloying elements, Zr is most effective in reducing the creep rate and extending the rupture life of NiAl alloys (see FIG. 2). Alloying with 0.4% Zr increases the rupture life of NAL-55 alloy (NiAl containing 0.7% Mo) by three orders of magnitude. When the level is higher than 0.4%, the Zr becomes less effective in improving the creep resistance of the NiAl alloys. Since Nb, Ta and Zr have low solubility in NiAl, the benefit of these elements comes mainly from a particle strengthening effect as pinning of mobile dislocations by fine Nb-, Zr- and Ta-rich precipitates, resulting in reducing the creep rate. From these studies, the preferred range of Nb or Ta is about 0.7±0.3 at. %, and the Zr concentration should be less than 0.7%.

Figure 3:
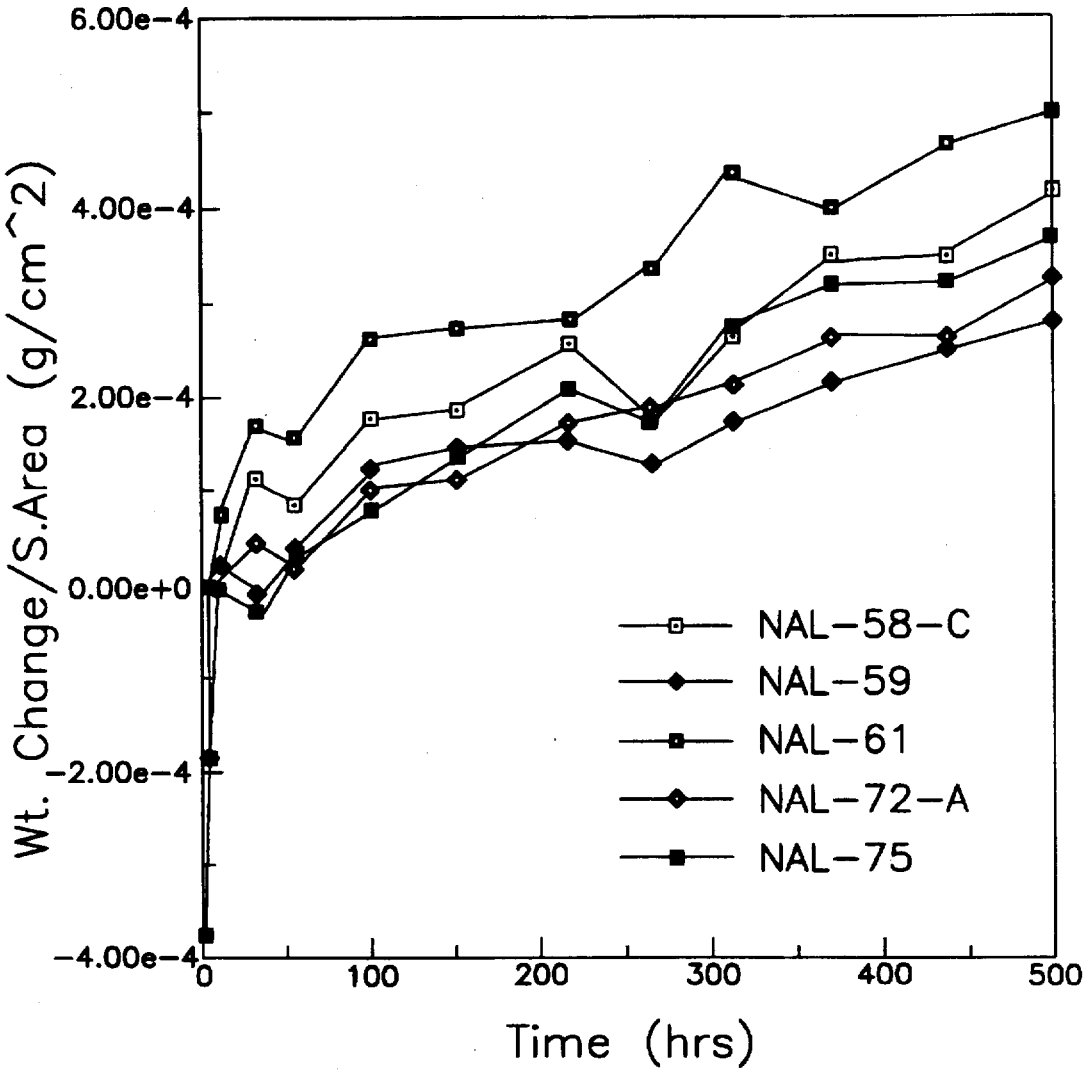
FIG. 3 is a plot of weight change of certain of the test NiAl-based alloys as a function of exposure time to air at 800° C.
Figure 4:
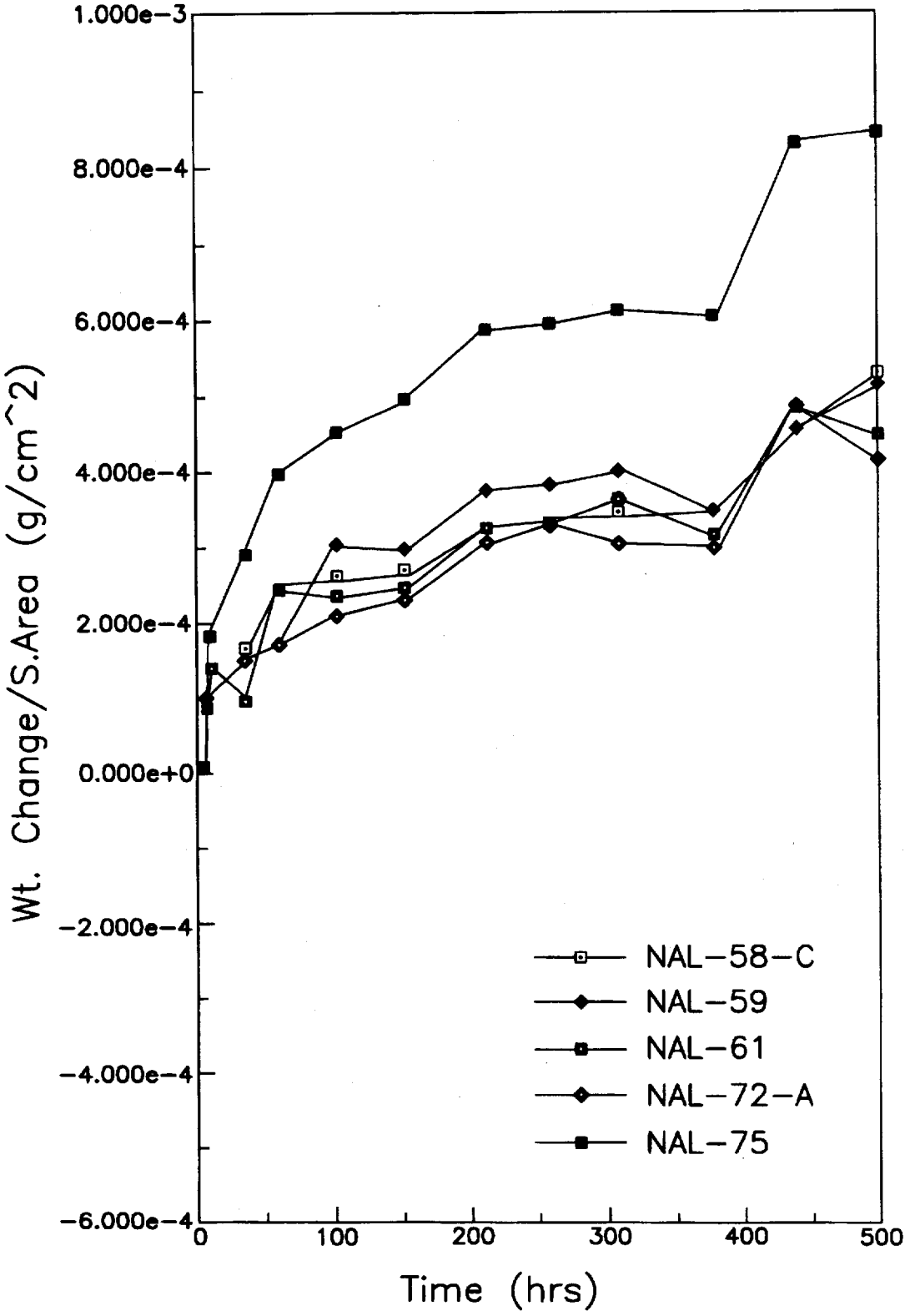
FIG. 4 is a plot of weight change of certain of the test NiAl-based alloys as a function of exposure time to air at 1000° C.

Selective of the alloys exhibiting improved ductility and strength were tested for their oxidation properties. Specifically, alloys NAL-58 (NiAl plus Mo), NAL-59 (NiAl plus Mo plus Nb), NAL-61 (NiAl plus Mo plus Ta) and NAL-72 NiAl plus Mo plus V) as listed in Table IV, were tested in air for up to 500 hours at 800° and 1000° C. These were first heat treated for one hour at 1100° C. plus one hour at 800° C. prior to air exposure. The alloy specimens were periodically removed from furnaces and cooled to room temperature for weight measurements. Results of these oxidations studies are shown in FIGS. 3 and 4 as a function of exposure time at the two temperatures, respectively. All of the alloys exhibited very low weight gain and showed no indication of spalling. At 800° C. the V-containing alloy showed the highest weight gain, while the Nb-containing alloy showed the lowest gain. The weight gain was about the same for all alloys at 1000° C., except for the V-containing alloy NAL-75 which showed distinctly a higher oxidation rate (FIG. 4).

From the foregoing it will be understood by persons skilled in the art that improved polycrystalline alloys based upon NiAl have been developed that exhibit mechanical properties more favorable than the tri-nickel aluminides. These improved alloys will have these improved mechanical properties at both room temperatures and at elevated temperatures. Thus, such alloys will have applications in many advanced technologies. When the alloys are to be used in cast form, they can be "investment" cast into components as is known in the art.

While various concentrations of alloying elements are set forth herein, these are for illustrating the present invention and not for the purpose of limitation. The invention is only to be limited by the appended claims, and their equivalents, when read together with the detailed description.

TABLE I

| Elements | Concentration (at. %) | | | | | | |
|---|---|---|---|---|---|---|---|
| Fe | <2.0* | 2.0†† | 5.9* | 10.0* | | | |
| Mo | 0.2* | 0.4* | 0.7†† | 1.0†† | 1.5†† | 2.0†† | 3.0†† |
| Cr | 1.0* | | | | | | |
| Ga | 1.0† | | | | | | |
| Ti | 0.4† | | | | | | |
| V | 0.4†† | | | | | | |
| Y | 0.0025†† | | | | | | |
| W | 0.4* | | | | | | |
| Mn | 1.0* | | | | | | |
| Cu | 2.0* | | | | | | |
| Ag | 2.0* | | | | | | |
| Zr | 0.04†† | 0.08†† | 0.2†† | 0.4†† | 0.7†† | 1.0†† | |
| Hf | | 0.8†† | | | | | |

*Substitution for Ni atoms.
†Substitution for Al atoms.
††Substitution for both Ni and Al atoms.

TABLE II

| Alloy no. | Molybdenum concentration (at. %) | Strength, MPa (ksi) Yield | Strength, MPa (ksi) Ultimate | Elongation (%) |
|---|---|---|---|---|
| | | Room temperature | | |
| NAL-31 | 0 | 154 (22.4) | 229 (33.3) | 2.2 |
| NAL-53 | 0.2 | 265 (38.5) | 425 (61.7) | 3.3 |
| NAL-44 | 0.4 | 254 (36.8) | 395 (57.3) | 3.6 |
| NAL-55 | 0.7 | 254 (36.8) | 425 (61.7) | 3.5 |
| NAL-57 | 1.0 | 277 (40.2) | 460 (66.8 | 3.4 |
| NAL-58 | 1.5 | 276 (40.1) | 486 (70.5) | 4.4 |
| NAL-66 | 2.0 | 396 (57.5) | 551 (80.0) | 3.4 |
| NAL-67 | 3.0 | 422 (61.2) | 530 (76.9) | 2.5 |
| | | 600° C. | | |
| NAL-31 | 0 | 90 (13.0) | 165 (24.0) | 58.5 |
| NAL-53 | 0.2 | 194 (28.2) | 277 (40.2) | 45.3 |
| NAL-44 | 0.4 | 179 (26.0) | 259 (37.6) | 32.6 |
| NAL-55 | 0.7 | 206 (29.9) | 297 (43.1) | 34.4 |
| NAL-57 | 1.0 | 240 (34.9) | 324 (47.1) | 38.9 |
| NAL-58 | 1.5 | 229 (33.3) | 304 (44.1) | 34.5 |
| | | 1000° C. | | |
| NAL-31 | 0 | 39 (5.6) | 49 (7.1) | 59.4 |
| NAL-53 | 0.2 | 111 (16.1) | 123 (17.8) | 36.3 |
| NAL-44 | 0.4 | 103 (15.0) | 110 (15.9) | 31.5 |
| NAL-55 | 0.7 | 121 (17.6) | 129 (18.7) | 45.2 |
| NAL-57 | 1.0 | 121 (17.5) | 133 (19.3) | 54.1 |
| NAL-58 | 1.5 | 116 (16.8) | 129 (18.7) | 43.8 |
| NAL-66 | 2.0 | 141 (20.5) | 152 (22.1) | 40.6 |
| NAL-67 | 3.0 | 121 (17.6) | 137 (19.9) | 42.9 |

TABLE III

| Alloy no. | Boron concentration (wppm) | Strength, MPa (ksi) Yield | Ultimate | Elongation (%) |
|---|---|---|---|---|
| | | Room temperature | | |
| NAL-44 | 0 | 254 (36.8) | 395 (57.3) | 3.6 |
| NAL-55 | 30 | 283 (41.1) | 461 (66.9) | 4.2 |
| | | 200° C. | | |
| NAL-44 | 0 | 249 (36.2) | 371 (53.9) | 3.6 |
| NAL-45 | 30 | 274 (39.8) | 408 (59.2) | 4.3 |
| | | 600° C. | | |
| NAL-44 | 0 | 179 (26.0) | 256 (37.6) | 32.6 |
| NAL-46 | 30 | 182 (26.4) | 263 (38.2) | 32.6 |
| | | 1000° C. | | |
| NAL-44 | 0 | 103 (15.0) | 110 (15.9) | 31.5 |
| NAL-45 | 30 | 102 (14.8) | 112 (16.3) | 36.9 |

TABLE IV

| Alloy no. | Alloy concentration (at. %) | Strength, MPa (ksi) Yield | Ultimate | Elongation (%) |
|---|---|---|---|---|
| | | Room temperature | | |
| NAL-31 | 0 | 154 (22.4) | 229 (33.3) | 2.2 |
| NAL-58 | 1.5 Mo | 276 (40.1) | 486 (70.5) | 4.4 |
| NAL-59 | 1.5 Mo + 0.4 Nb | 325 (47.2) | 466 (67.7) | 2.8 |
| NAL-60 | 1.5 Mo + 1.0 Nb | 402 (58.3) | 431 (62.6) | 1.0 |
| NAL-61 | 1.5 Mo + 0.4 Ta | 328 (47.6) | 472 (68.5) | 2.9 |
| NAL-62 | 1.5 Mo + 1.0 Ta | 388 (56.3) | 413 (59.9) | 1.3 |
| NAL-72 | 1.5 Mo + 0.4 V | 340 (49.3) | 513 (74.4) | 3.4 |
| NAL-73 | 1.5 Mo + 1.0 V | 338 (49.1) | 494 (71.7) | 2.5 |
| | | 1000° C. | | |
| NAL-31 | 0 | 39 (5.6) | 49 (7.1) | 59.4 |
| NAL-58 | 1.5 Mo | 116 (16.8) | 129 (18.7) | 43.8 |
| NAL-59 | 1.5 Mo + 0.4 Nb | 166 (24.1) | 181 (26.2) | 35.6 |
| NAL-60 | 1.5 Mo + 1.0 Nb | 195 (28.3) | 225 (32.6) | 40.5 |
| NAL-61 | 1.5 Mo + 0.4 Ta | 134 (19.4) | 146 (21.2) | 36.8 |
| NAL-62 | 1.5 Mo + 1.0 Ta | 163 (23.6) | 188 (27.3) | 27.4 |
| NAL-72 | 1.5 Mo + 0.4 V | | | |
| NAL-73 | 1.5 Mo + 1.0 V | 143 (20.8) | 155 (22.5) | 41.6 |

TABLE V

| Alloy number | Alloy concentration (at. %) | Strength, MPa (ksi) Yield | Ultimate | Elongation (%) |
|---|---|---|---|---|
| | | Room temperature | | |
| NAL-31 | 0 | 154 (22.4) | 229 (33.3) | 2.2 |
| NAL-55 | 0.7 Mo | 254 (36.8) | 425 (61.7) | 3.5 |
| NAL-74 | 0.7 Mo + 0.4 V + 0.4 Ta | 340 (49.4) | 488 (70.8) | 2.9 |
| NAL-75 | 0.7 Mo + 0.4 Nb + 0.4 V | 387 (56.1) | 461 (66.9) | 1.6 |
| NAL-76 | 0.7 Mo + 0.4 Nb + 0.4 V + 0.24 Ta | 434 (63.0) | 493 (71.5) | 1.6 |
| NAL-77 | 0.7 Mo + 0.4 Nb + 1.0 V | 435 (63.2) | 477 (69.2) | 1.1 |
| | | 1000° C. | | |
| NAL-31 | 0 | 39 (5.6) | 49 (7.1) | 59.4 |
| NAL-55 | 0.7 Mo | 121 (17.6) | 129 (18.7) | 45.2 |
| NAL-75 | 0.7 Mo + 0.4 Nb + 0.4 V | 194 (28.1) | 278 (40.4) | 32.7 |

TABLE V-continued

| Alloy number | Alloy concentration (at. %) | Strength, MPa (ksi) Yield | Ultimate | Elongation (%) |
|---|---|---|---|---|
| NAL-76 | 0.7 Mo + 0.4 Nb + 0.4 V + 0.24 Ta | 260 (37.8) | 318 (46.2) | 27.5 |
| NAL-77 | 0.7 Mo + 0.4 Nb + 1.0 V | 294 (42.6) | 342 (49.6) | 31.3 |

TABLE VI

| Alloy number | Alloy concentration (at. %) | Strength, MPa (ksi) Yield | Ultimate | Elongation (%) |
|---|---|---|---|---|
| | | Room temperature | | |
| NAL-31 | 0 | 154 (22.4) | 229 (33.3) | 2.2 |
| NAL-55 | 0.7 Mo | 254 (36.8) | 425 (61.7) | 3.5 |
| NAL-96 | 0.7 Mo + 0.08 Zr | 479 (69.5) | 479 (69.5) | 0.3 |
| NAL-84 | 0.7 Mo + 0.2 Zr | 608 (88.2) | 608 (88.2) | 0.4 |
| NAL-82 | 0.7 Mo + 0.4 Zr | 600 (87.1) | 600 (87.1) | 0.4 |
| NAL-93 | 0.7 Mo + 0.7 Zr | 576 (83.6) | 576 (83.6) | 0.4 |
| NAL-83 | 0.7 Mo + 1.0 Zr | 201 (29.2) | 201 (29.2) | 0.1 |
| NAL-97 | 0.7 Mo + 0.08 Zr + 0.2 Fe | 530 (76.9) | 569 (82.6) | 1.2 |
| NAL-85 | 0.7 Mo + 0.4 Zr + 50B* | 644 (93.4) | 644 (93.4) | 0.4 |
| NAL-86 | 0.7 Mo + 0.4 Zr + 100B* | 620 (90.0) | 620 (90.2) | 0.4 |
| NAL-87 | 0.7 Mo + 0.4 Zr + 100C* | 598 (86.8) | 598 (86.8) | 0.4 |
| NAL-88 | 0.7 Mo + 0.4 Zr + 0.4 Nb | 625 (90.7) | 625 (90.7) | 0.4 |
| NAL-91 | 0.7 Mo + 0.4 Zr + 0.4 Nb + 0.24 Ta + 100C* | 640 (92.9) | 640 (92.9) | 0.4 |
| NAL-92 | 0.7 Mo + 0.4 Zr + 0.4 Nb + 0.4 V + 0.24 Ta | 606 (88.0) | 606 (88.0) | 0.4 |
| | | 1000° C. | | |
| NAL-31 | 0 | 39 (5.6) | 49 (7.1) | 59.4 |
| NAL-55 | 0.7 Mo | 121 (17.6) | 129 (18.7) | 45.2 |
| NAL-84 | 0.7 Mo + 0.2 Zr | 318 (46.2) | 365 (53.0) | 41.6 |
| NAL-82 | 0.7 Mo + 0.4 Zr | 329 (47.8) | 361 (52.4) | 52.7 |
| NAL-83 | 0.7 Mo + 1.0 Zr | 283 (41.1) | 336 (48.8) | 43.7 |
| NAL-86 | 0.7 Mo + 0.4 Zr + 100B* | 305 (44.3) | 340 (49.3) | 42.5 |
| NAL-87 | 0.7 Mo + 0.4 Zr + 100C* | 336 (48.7) | 366 (53.1) | 48.7 |
| NAL-88 | 0.7 Mo + 0.4 Zr + 0.4 Nb | 349 (50.7) | 349 (50.7) | 41.0 |
| NAL-92 | 0.7 Mo + 0.4 Zr + 0.4 Nb + 0.4 V + 0.24 Ta | 369 (53.5) | 400 (58.1) | 47.3 |

*wt ppm

TABLE VII

| Alloy number | Alloy concentration (at. %) | Rupture life (h) | Minimum creep rate (%/h) | Rupture elongation (%) |
|---|---|---|---|---|
| NAL-31 | 0 | <0.1 | — | — |
| NAL-55 | 0.7 Mo | 3.7 | 1.7 | 33.5 |
| NAL-66 | 2.0 Mo | 4.5 | 2.4 | 30.2 |
| NAL-59 | 1.5 Mo + 0.4 Nb | 56.8 | — | 45.6 |
| NAL-60 | 1.5 Mo + 1.0 Nb | 231 | 0.015 | 50.4 |
| NAL-61 | 1.5 Mo + 0.4 Ta | 18.4 | — | 54.0 |
| NAL-62 | 1.5 Mo + 1.0 Ta | 715 | 0.0086 | 57.1 |
| NAL-72 | 1.5 Mo + 0.4 V | 1.2 | 10.0 | 40.3 |
| NAL-73 | 1.0 Mo + 4.0 V | 15.4 | 0.50 | 50.8 |
| NAL-75 | 0.7 Mo + 0.4 Nb + 0.4 V | 369 | 0.011 | 41.6 |
| NAL-76 | 0.7 Mo + 0.4 Nb + 0.4 V + 0.24 Ta | 501 | 0.012 | 68.6 |
| NAL-82 | 0.7 Mo + 0.4 Zr | 2527 | 0.001 | 46.2 |

TABLE VII-continued

| Alloy number | Alloy concentration (at. %) | Rupture life (h) | Minimum creep rate (%/h) | Rupture elongation (%) |
|---|---|---|---|---|
| NAL-93 | 0.7 Mo + 0.7 Zr | 615 | 0.003 | 18.1 |
| NAL-83 | 0.7 Mo + 1.0 Zr | 474 | 0.014 | 20.0 |

I claim:

1. A nickel aluminide alloy composition comprising 0.7 to 1.6 atomic percent molybdenum, about 49.1±0.8 atomic percent aluminum, and a remainder of said alloy composition being nickel, said molybdenum being substituted for both nickel and aluminum atoms in said alloy composition.

2. The alloy composition of claim 1 further including from nearly zero to about 0.03 atomic percent of an element selected from the group consisting of boron and carbon.

3. The alloy composition of claim 1 further including about 0.2 to about 1.6 atomic percent of a metal selected from the group consisting of iron, niobium, tantalum, zirconium, hafnium and combinations thereof.

4. The alloy composition of claim 3 wherein said metal is selected from the group consisting of niobium, zirconium and combinations thereof.

5. The alloy composition of claim 3 further including about 0.001 to about 0.03 atomic percent of an element selected from the group consisting of boron and carbon.

* * * * *